US008077092B2

(12) United States Patent
Coupez et al.

(10) Patent No.: US 8,077,092 B2
(45) Date of Patent: Dec. 13, 2011

(54) PLANAR ANTENNA WITH CONDUCTIVE STUDS EXTENDING FROM THE GROUND PLANE AND/OR FROM AT LEAST ONE RADIATING ELEMENT, AND CORRESPONDING PRODUCTION METHOD

(75) Inventors: Jean-Philippe Coupez, Le Relecq Kerhuon (FR); Christian Person, Locmaria-Plouzane (FR); Serge Pinel, Brest (FR)

(73) Assignee: Ecole Nationale Superieure des Telecommunications de Bretagne, Brest (FR)

( * ) Notice: Subject to any disclaimer, the term of this patent is extended or adjusted under 35 U.S.C. 154(b) by 227 days.

(21) Appl. No.: 11/579,078

(22) PCT Filed: Apr. 19, 2005

(86) PCT No.: PCT/FR2005/000966

§ 371 (c)(1),
(2), (4) Date: Dec. 21, 2007

(87) PCT Pub. No.: WO2005/117208

PCT Pub. Date: Dec. 8, 2005

(65) Prior Publication Data

US 2008/0198086 A1 Aug. 21, 2008

(30) Foreign Application Priority Data

Apr. 30, 2004 (FR) ..... 04 04679
Mar. 2, 2005 (FR) ..... 05 02130

(51) Int. Cl.
*H01Q 1/38* (2006.01)

(52) U.S. Cl. ..... 343/700 MS; 343/824; 343/846

(58) Field of Classification Search ..... 343/846, 343/824, 829, 893, 700 MS, 725
See application file for complete search history.

(56) References Cited

U.S. PATENT DOCUMENTS

| | | | | |
|---|---|---|---|---|
| 4,063,245 | A * | 12/1977 | James et al. | 343/700 MS |
| 4,259,670 | A | 3/1981 | Schiavone | |
| 4,367,474 | A | 1/1983 | Schaubert et al. | |
| 4,376,296 | A | 3/1983 | Bhagwat et al. | |
| 4,379,296 | A | 4/1983 | Farrar et al. | |
| 4,386,357 | A * | 5/1983 | Patton | 343/700 MS |
| 4,827,266 | A | 5/1989 | Sato | |
| 4,924,236 | A * | 5/1990 | Schuss et al. | 343/700 MS |
| 5,691,732 | A * | 11/1997 | Tsuru et al. | 343/745 |
| 6,483,462 | B2 | 11/2002 | Weinberger | |

(Continued)

FOREIGN PATENT DOCUMENTS

JP 53-132255 11/1978

(Continued)

OTHER PUBLICATIONS

European Patent Office Communication (with English translation) for application No. 05 759 955.7, mailed Oct. 15, 2009.

(Continued)

*Primary Examiner* — Tan Ho

(57) ABSTRACT

The disclosure relates to a planar antenna comprising at least one radiator element separated from a ground plane by a dielectric. The antenna also comprises an assembly of conductive studs which is connected to and extends from at least one element of a group of elements comprising the ground plane and at least one radiator element in such a way that at least one physical dimension of said at least one radiator element for a determined resonance frequency is reduced.

26 Claims, 7 Drawing Sheets

U.S. PATENT DOCUMENTS

| | | | | |
|---|---|---|---|---|
| 6,624,786 | B2 * | 9/2003 | Boyle | 343/700 MS |
| 6,768,476 | B2 * | 7/2004 | Lilly et al. | 343/909 |
| 6,870,514 | B2 * | 3/2005 | Simpson | 343/846 |
| 6,930,639 | B2 | 8/2005 | Bauregger et al. | |
| 7,055,754 | B2 * | 6/2006 | Forster | 235/492 |
| 7,710,324 | B2 * | 5/2010 | Tatarnikov et al. | 343/700 MS |
| 2003/0210188 | A1 * | 11/2003 | Hebron et al. | 343/700 MS |
| 2003/0214443 | A1 | 11/2003 | Bauregger et al. | 343/700 |

FOREIGN PATENT DOCUMENTS

| | | |
|---|---|---|
| JP | 61-196603 | 8/1986 |
| JP | 10-224142 | 8/1998 |
| JP | 11-251825 | 9/1999 |
| WO | WO 01/17063 | 3/2001 |
| WO | WO 01/31739 | 5/2001 |
| WO | WO 01/63695 | 8/2001 |
| WO | WO-01/93373 | 12/2001 |
| WO | WO 02/052680 | 7/2002 |
| WO | WO 02/087012 | 10/2002 |
| WO | WO 02/087012 A1 | 10/2002 |
| WO | WO 02/101874 | 12/2002 |

OTHER PUBLICATIONS

Seo J-S et al. "Miniaturisation of Microstrip antenna using irises," Electronics Letters, IEE Stevenage, GB, vol. 40, No. 12, Jun. 10, 2004, pp. 718-719, XP006022151, ISSN: 0013-5194.

Office Action for Japanese Application 2007-510070, dispatched Oct. 6, 2009 (English translation included).

First Office Action for Chinese Application 200580019034.4, issued Mar. 26, 2010 (with English Translation).

Official Notice of Rejection for Japanese patent Application No. 2007-510070, mailed Apr. 27, 2010 (with English Translation).

English Translation of the International Preliminary Report on Paternability in counterpart foreign application No. PCT/FR2005/000966 filed Apr. 19, 2005.

Final Decision of Rejection on Japanese Patent Application No. 2007-510070, mailed Dec. 17, 2010 (with English translation).

* cited by examiner

PLANAR ANTENNA WITH CONDUCTIVE STUDS EXTENDING FROM THE GROUND PLANE AND/OR FROM AT LEAST ONE RADIATING ELEMENT, AND CORRESPONDING PRODUCTION METHOD

CROSS-REFERENCE TO RELATED APPLICATION

This Application is a Section 371 National Stage Application of International Application No. PCT/FR2005/000966, filed Apr. 19, 2005 and published as WO 2005/117208 on Dec. 8, 2005, not in English.

FIELD OF THE DISCLOSURE

The field of the disclosure is that of planar antennas of the type that include at least one radiating element (also known as a "patch", planar pattern, radiating pattern or printed pattern) separated from a ground plane by a dielectric.

Our era is currently experiencing a significant expansion in mobile networks, and, more generally, in all "wireless" networks. Since such systems bring attractive responses on many points, such as connection flexibility, mobility, redeployment or the possibilities of network extension, this expansion should continue to grow in a highly significant manner in the future.

In fact, in all these systems, the radiating elements are part of the key components, in respect of which the required specifications are increasingly restrictive. Clearly all areas of electrical performance in relation to these antennas need constantly to be optimised, but there is also a need to satisfy increasingly critical criteria, such as the space requirement, the weight or the cost of these components.

Antenna miniaturisation currently represents therefore a significant challenge and a great deal of work is being done in this area at an international level. This miniaturisation offers in fact a great many advantages, among which may be cited: the ease with which antennas can be built into on-board equipment (particularly, within mobiles), greater flexibility in networking these radiating elements (on account of their small size), a wider diagram aperture facilitating in particular the incorporation of wide beam steering systems etc.

Among the different technologies used to incorporate the antennas, planar solutions today seem particularly appropriate in order to meet all the required specifications. This planar approach in fact offers designers sufficient flexibility in the development of effective solutions with particularly small dimensions.

By an entirely classic misuse of language in the field of antennas, "planar antennas" (or antennas implemented using planar technology) are taken to be:

- both antennas that are actually plane, in respect of which the ground plane and the radiating element or elements are plane,
- and antennas that are not actually plane, in other words for which the ground plane and/or at least one of the radiating elements is not (or are not) plane but modelled to a given three-dimensional (3D) shape, so as to conform in shape to a support.

Planar antennas of the aforementioned second category (antennas that are not actually plane) are generally, but not compulsorily, made using a printed technology. This explains why, historically, the adjective "planar" has been selected in the expression "planar antenna", to show an opposition with the traditional antenna structure based on a three-dimensional (3-D) waveguide. The present disclosure falls within this framework and relates more exactly to an original planar antenna solution in the aforementioned sense, and to a method of manufacture thereof, allowing the physical size of the basic printed pattern (in other words of the radiating element or elements, also known as patches) to be considerably reduced.

BACKGROUND OF THE DISCLOSURE

The reduction in the size of planar antennas is a major issue in making them easier to use and to incorporate in modem systems.

The basic principle of most of the solutions implemented hitherto consists in increasing the equivalent electrical length of the printed pattern, so that it can radiate at the required frequency, while reducing its physical dimensions (i.e. its surface or its volume).

To this end, the most commonly used structures correspond to:

- patch type solutions with inscribed slots, these slots allowing the electrical path of the signal to be elongated over the planar pattern (see for example patent documents WO 01/31739 and WO 01/17063), or
- solutions for which the radiating pattern is folded back so as to gain in compactness (see for example patent documents WO 02/052680, WO 01/63695 and U.S. Pat. No. 6,483,462 B2).

It should be noted that these different concepts may also be combined within one and the same structure (see for example patent document WO 02/101874).

SUMMARY

An embodiment of the invention uses a planar antenna of the type that comprises at least one radiating element separated from a ground plane by a dielectric. According to an embodiment of the invention, the antenna further comprises at least one assembly of conductive studs connected to and extending from at least one of the elements belonging to the group comprising the ground plane and said at least one radiating element, in order to reduce at least one physical dimension of said at least one radiating element for a given resonant frequency.

The general principle of an embodiment of the invention therefore consists simply in arranging studs on the ground plane and/or on one or more radiating element(s) (patch(es)) of the planar antenna.

In the context of an embodiment of the present invention, the term stud is used in a generic sense, in that it is able to be broken down into different variants (and particularly but not exclusively, as set out in detail in the disclosure below, in the form of a projection, a hole or again a tab).

Dielectric is taken to mean the air or a solid material with characteristics close to those of air, such as for example materials of the plastic, or foam type etc., As explained in detail below, in relation to FIG. 3, these studs have the effect of locally modifying the distribution of the electromagnetic field, and allowing at least one physical dimension (the length and/or the width) of the radiating element or elements to be reduced for a fixed resonant frequency.

Different assemblies of conductive studs are specified hereinafter. It is clear that there are many conceivable embodiments of the present invention, each corresponding to a different combination of one or more of these assemblies. It should also be noted that an embodiment of the present invention applies with an antenna structure that comprises a single radiating element or with an antenna structure that comprises a stack of several radiating elements.

To advantage, the antenna comprises a first assembly of conductive studs connected to the ground-plane and extending towards, without being connected to, said at least one radiating element.

In the event of the antenna being of the type that comprises a single radiating element, it comprises to advantage a second assembly of conductive studs connected to said single radiating element and extending towards, without being connected to, said ground plane.

In the event of the antenna being of the type that comprises a stack of at least two radiating elements separated from each other by a dielectric, the radiating element closest to the ground plane being known as the primary radiating element, the antenna comprises to advantage a third assembly of conductive studs connected to a first surface of said primary radiating element and extending towards, without being connected to, said ground plane.

In the event of the antenna being of the type that comprises a stack of at least two radiating elements separated from each other by a dielectric, the radiating element closest to the ground plane being known as the primary radiating element, the antenna comprises to advantage a fourth assembly of conductive studs connected to a second surface of said primary radiating element and extending towards, without being connected to, another of said radiating elements.

In the event of the antenna being of the type that comprises a stack of at least three radiating elements separated from each other by dielectrics, the radiating element closest to the ground plane being known as the primary radiating element, the radiating element furthest away from the ground plane being known as the upper radiating element, each radiating element other than the primary radiating element and the upper radiating element being known as an intermediate radiating element, the antenna comprises to advantage, for at least one of the intermediate radiating elements, a fifth assembly of conductive studs connected to a first surface of said intermediate radiating element and extending towards, without being connected to, another of said radiating elements which follows said intermediate radiating element along a direction of run of said stack of the primary radiating element towards the upper radiating element.

In the event of the antenna being of the type that comprises a stack of at least three radiating elements separated from each other by dielectrics, the radiating element closest to the ground plane being known as the primary radiating element, the radiating element furthest away from the ground plane being known as the upper radiating element, each radiating element other than said primary radiating element and said upper radiating element being known as an intermediate radiating element, the antenna comprises to advantage, for at least one of the intermediate radiating elements, a sixth assembly of conductive studs connected to a second surface of said intermediate radiating element and extending towards, without being connected to, another of said radiating elements which precedes said intermediate radiating element along a direction of run of said stack of the primary radiating element towards the upper radiating element.

In the event of the antenna being of the type that comprises a stack of at least two radiating elements separated from each other by a dielectric, the radiating element closest to the ground plane being known as the primary radiating element, the radiating element furthest away from the ground plane being known as the upper radiating element, each radiating element other than said primary radiating element and said upper radiating element being known as an intermediate radiating element, the antenna comprises to advantage a seventh assembly of conductive studs connected to a first surface of said upper radiating element and extending towards, without being connected to, another of said radiating elements which precedes said upper radiating element along a direction of run of said stack of the primary radiating element towards the upper radiating element.

To advantage, an assembly of conductive studs, extending from the ground plane of from one of the radiating elements respectively, interlaces with another assembly of conductive studs, extending from one of the radiating elements or from another of the radiating elements respectively.

To advantage, for each radiating element to which an assembly of conductive studs is connected, said radiating element is not connected to any conductive stud in an area where said radiating element is connected with power supply means.

To advantage, the conductive studs of one and the same assembly of conductive studs are distributed in a matrix.

According to one advantageous characteristic, at least one radiating element to which at least one assembly of conductive studs is connected is of the type that has symmetry along its two main axes, and in that said conductive studs are distributed in an arrangement that respects said symmetry.

In this way, it is perfectly possible to use the antenna of an embodiment of the invention in accordance with two crossed linear polarisations, or even in circular polarisation. The solution developed, based on conductive studs, is not therefore per se an obstacle to the use of the antenna for any type of required polarisation.

Preferentially, the antenna belongs to the group comprising: planar antennas of the half-wave radiating element type, planar antennas of the quarter-wave radiating element type, planar antennas of the annular radiating element type, planar antennas of the inscribed slot radiating element type, planar antennas of the inverted-F radiating element type.

To advantage, the antenna belongs to the group comprising: plane antennas and antennas that are not plane on account of the non-planeness of the ground plane and/or of at least one of the radiating elements.

In a first particular embodiment of the invention, at least one of the conductive studs connected to the ground plane or to one of the radiating elements is a conductive projection formed in a first conductive component and extending from a principal body of said first conductive component, said principal body forming said ground plane or said radiating element.

In a second particular embodiment of the invention, at least one of the conductive studs connected to at least one of the radiating elements is a conductive tab, cut from at least one excentric part of a second conductive component, and folded back relative to a central part of the second conductive component, said central part forming said radiating element.

To advantage, the antenna further comprises at least one support element of said first or second conductive component, made of a dielectric material and allowing the ground plane to be positioned relative to at least one of the radiating elements or said radiating element to be positioned relative to the ground plane or at least one other of the radiating elements.

In a third particular embodiment of the invention, at least one of the conductive studs connected to the ground plane or to at least one of the radiating elements is a conductive hole extending from a first surface of a layer of dielectric material, said first surface carrying said ground plane or said at least one radiating element, said conductive hole extending from said first surface and not emerging on a second surface of said layer of dielectric material, the surface of said conductive hole being coated with a conductive material.

An embodiment of the invention also relates to a process for manufacturing a planar antenna of the type that comprises at least one radiating element separated from a ground plane by a dielectric. According to an embodiment of the invention, the method comprises a stage of implementing at least one assembly of conductive studs connected to and extending from at least one of the elements belonging to the group comprising the ground plane and said at least one radiating element, so as to reduce at least one physical dimension of said at least one radiating element for a given resonant frequency.

In a first particular embodiment of the invention, the method comprises the following stage, for the ground plane and/or at least one of the radiating elements to which an assembly of conductive studs is connected: a first conductive component is implemented comprising:

- a principal body forming said ground plane or said radiating element; and
- at least one conductive projection extending from said principal body, so as to form one of the conductive studs connected to the ground plane or to one of the radiating elements.

In a second particular embodiment of the invention, the process comprises the following stages, for at least one of the radiating elements to which an assembly of conductive studs is connected:

- a second conductive component is implemented comprising a central part forming said radiating element;
- at least one conductive tab is cut from an excentric part of said second conductive component;
- said at least one conductive tab is folded back relative to the central part, so as to form one of the conductive studs connected to one of the radiating elements.

To advantage, the process further comprises a stage of positioning said first or second conductive component relative to another element of the antenna, using at least one support element made of a dielectric material.

In a third particular embodiment of the invention, the method comprises the following stages, for the ground plane and/or at least one of the radiating elements to which an assembly of conductive studs is connected:

- at least one hole is implemented in a layer of dielectric material, said at least one hole extending from a first surface of said layer and not emerging on a second surface of said layer;
- a coating of conductive material is applied selectively to:
- at least one part of said first surface, so as to form said ground plane or said radiating element; and
- the surface of said at least one hole, so as to obtain a conductive hole forming one of the conductive studs connected to the ground plane or to one of the radiating elements.

BRIEF DESCRIPTION OF THE DRAWINGS

Other characteristics and advantages will emerge from reading the following description of a preferential embodiment of the invention, which is given purely by way of example and in no way restrictively, and of the attended drawings, wherein.

Figure 1:
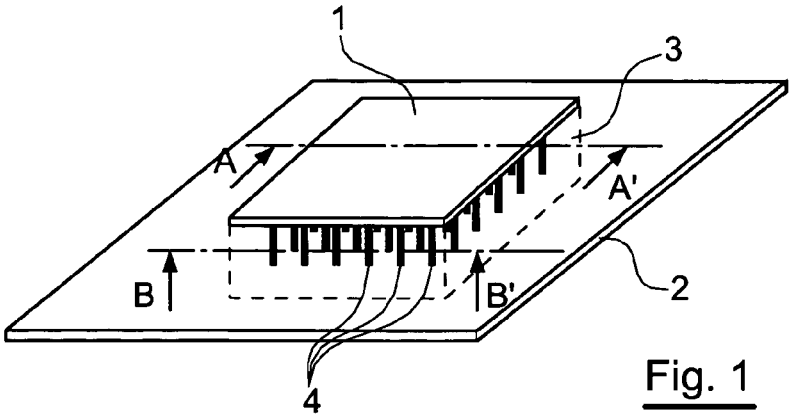
FIG. 1 shows a perspective view of an example of a planar antenna of the half-wave patch type according to an embodiment of the invention, with studs distributed under the radiating element.
Figure 3:
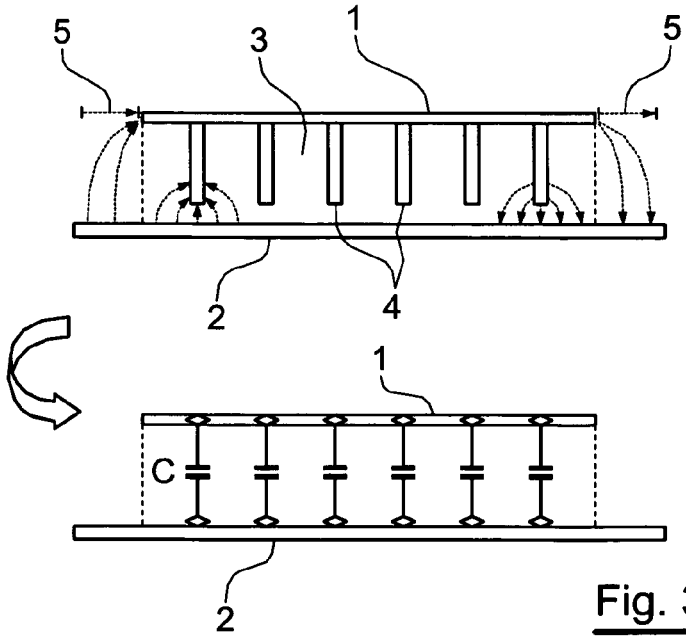
Figure 4:
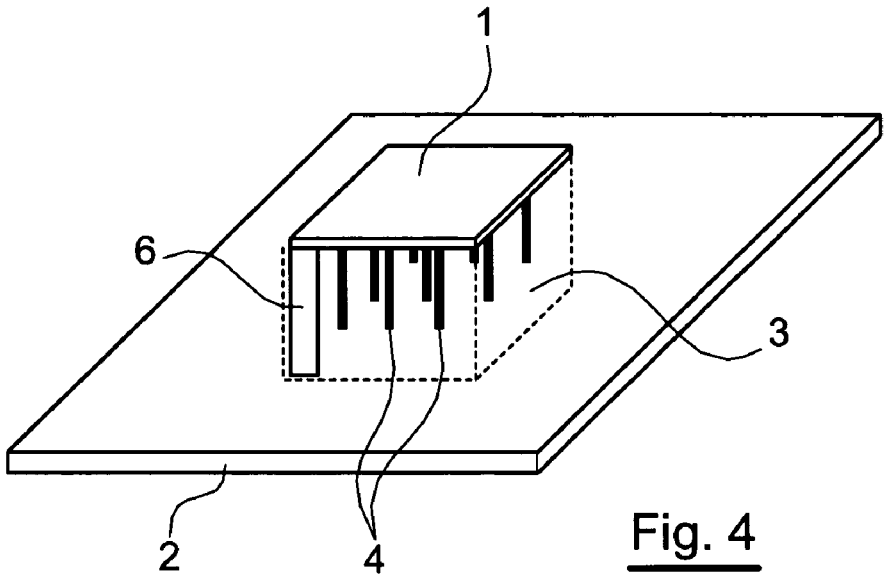
Figure 5:
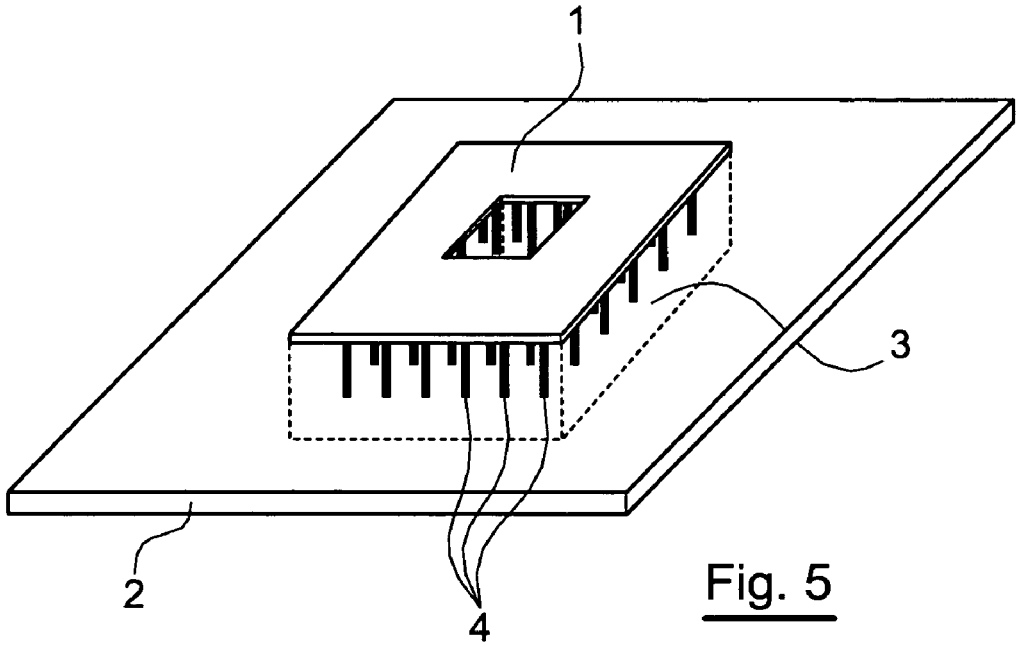
Figure 6:
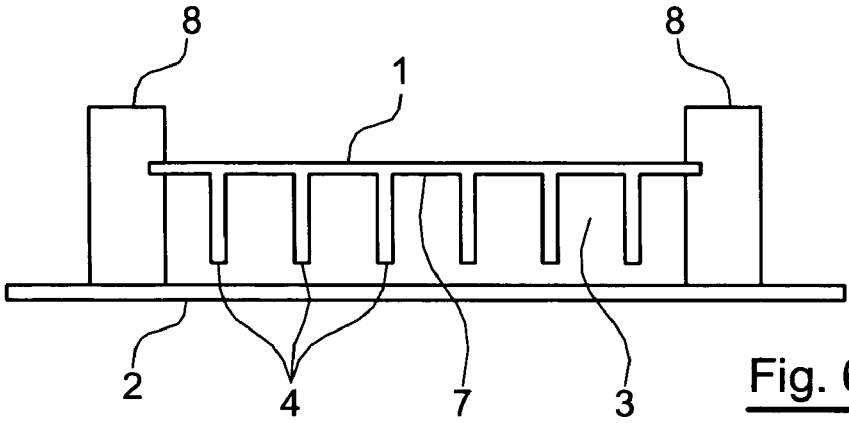
Figure 7:
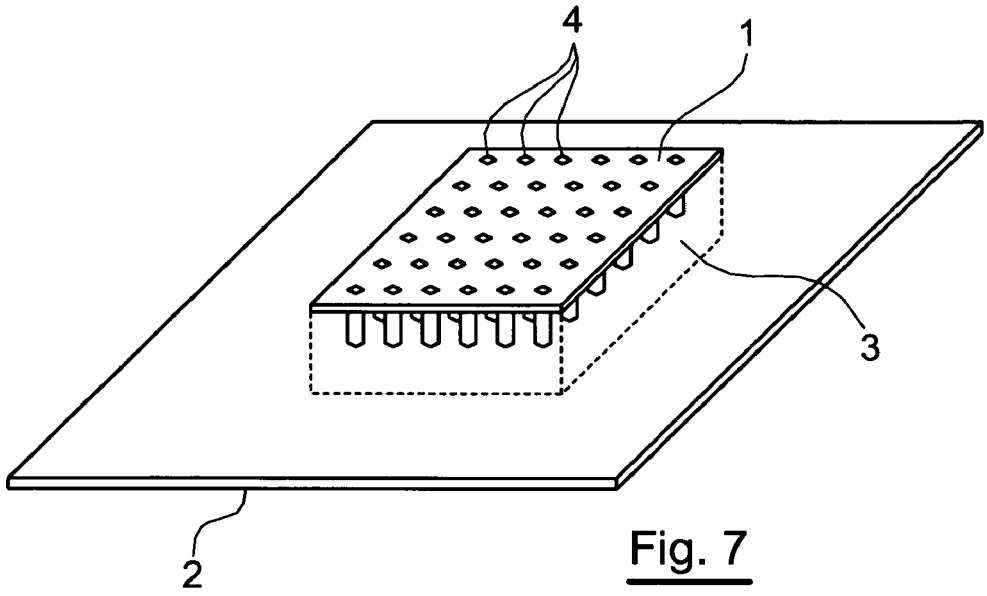
Figure 8:
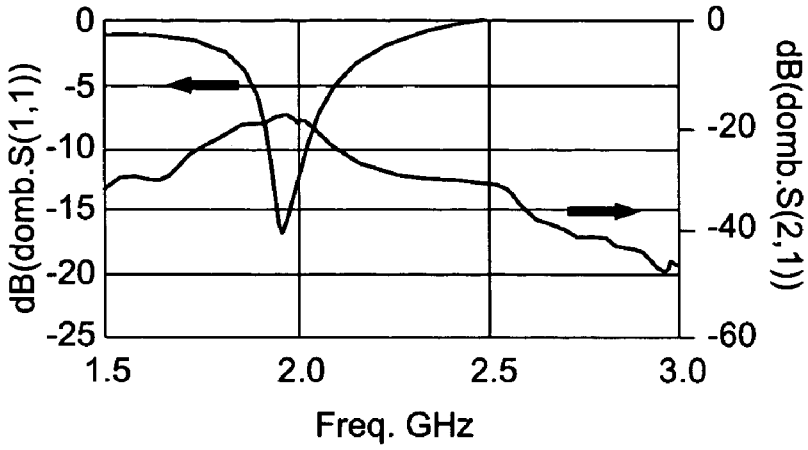
Figure 9:
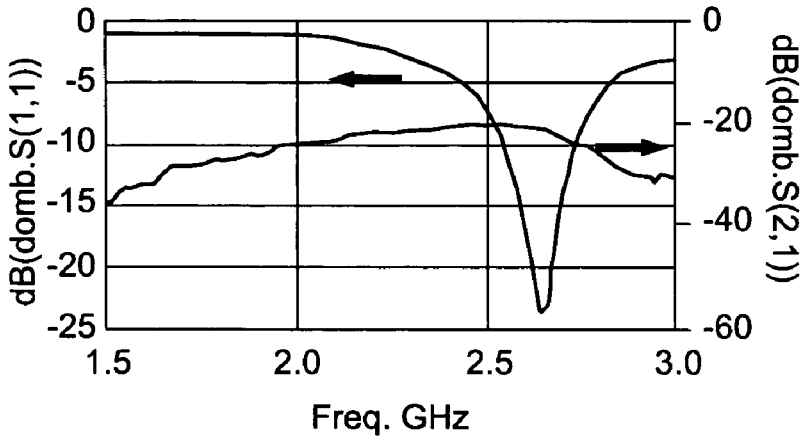
Figure 10:
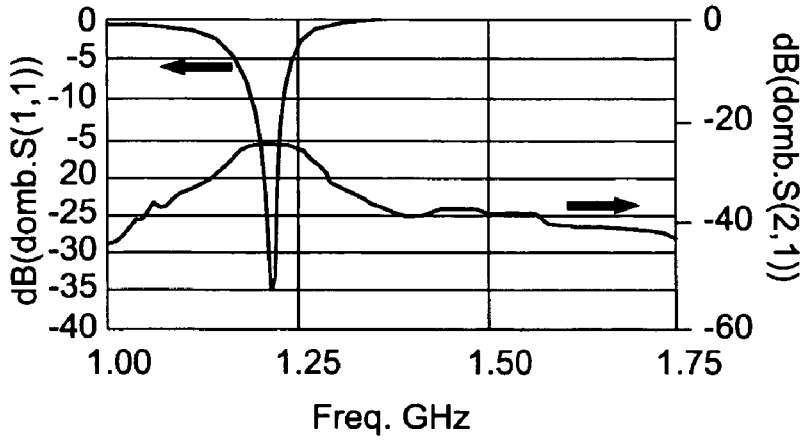
Figure 11:
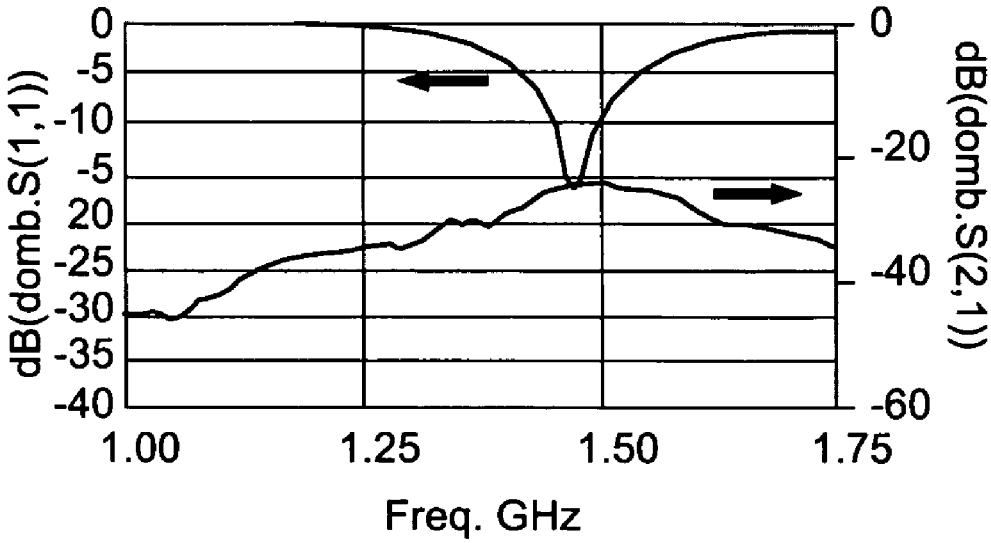
Figure 12:
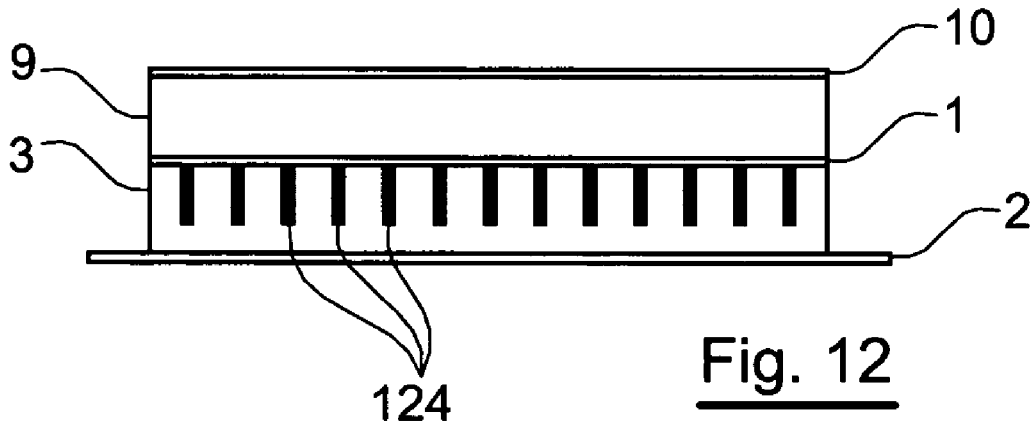
Figure 13:
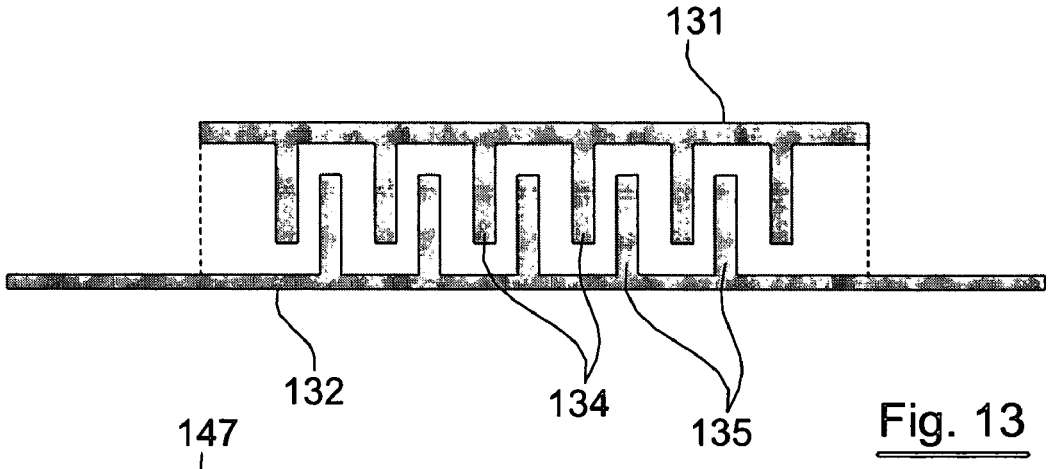
Figure 14:
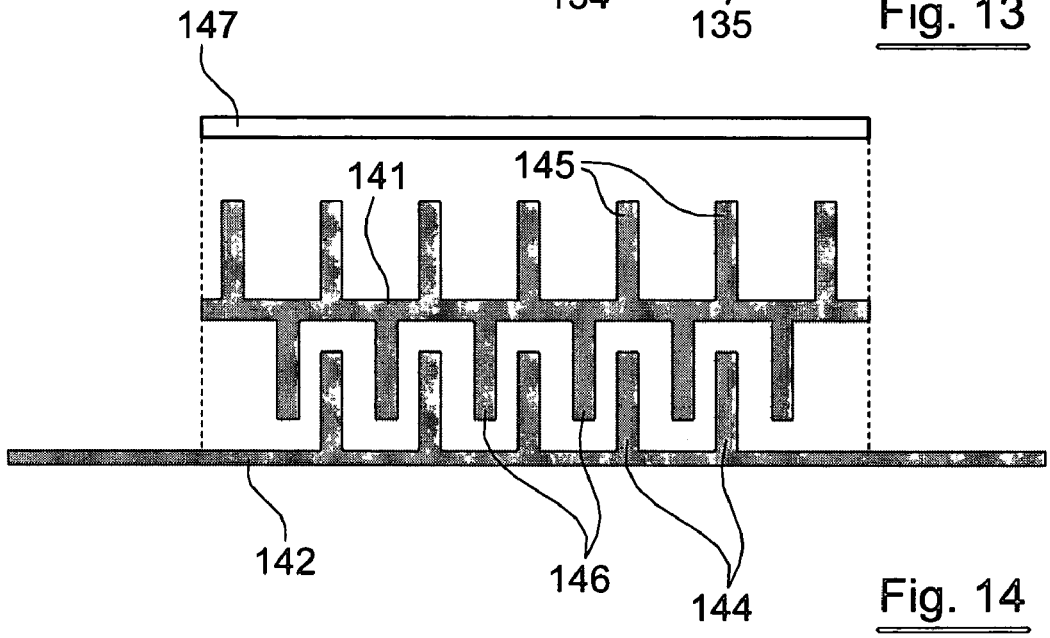
Figure 15:
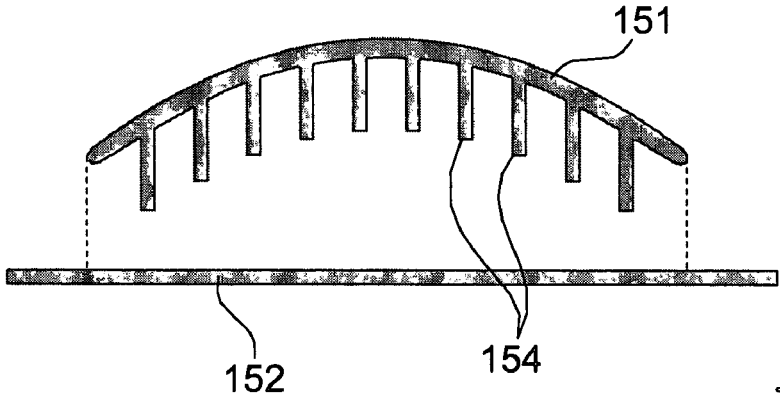
Figure 16:
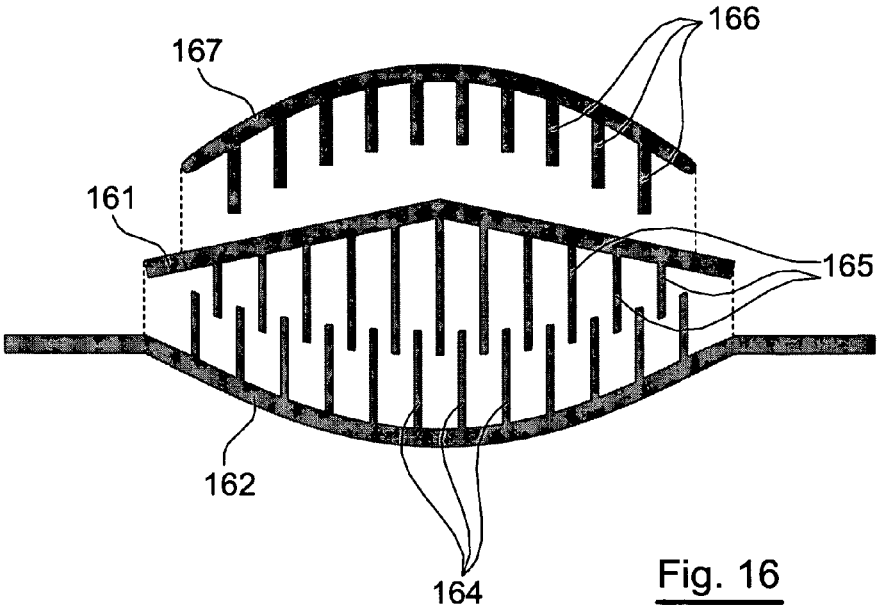
Figure 17:
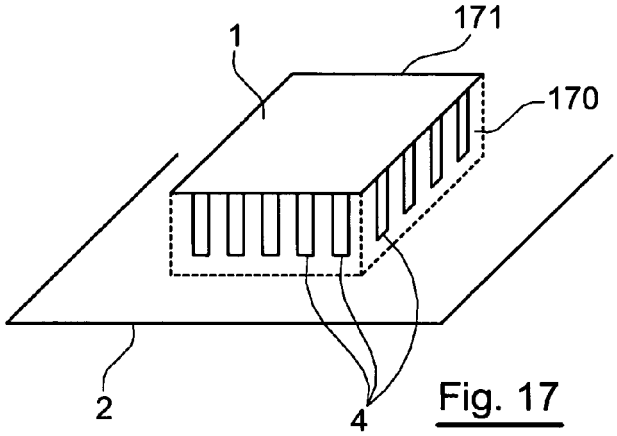
Figure 18:
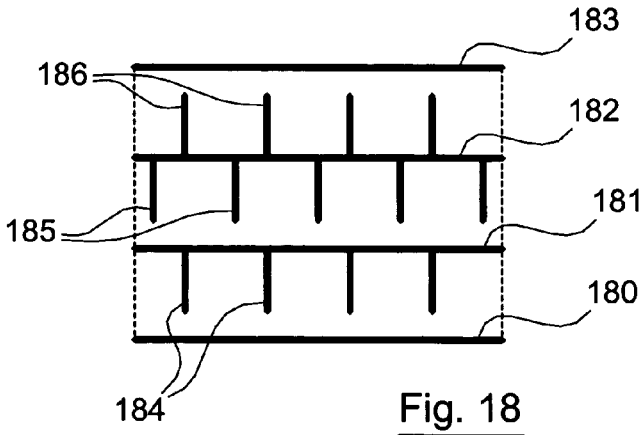

the upper part of FIG. 3 is a cross-section view of the antenna in FIG. 1 along the axis A-A', making it possible to interpret the effect of the studs positioned under the radiating element, and the lower part of FIG. 3 is an electric modelling of the effect of the studs;

FIG. 4 shows an example of a planar antenna of the quarter-wave patch type according to an embodiment of the invention, with studs distributed under the radiating element;

FIG. 5 shows an example of a planar antenna of the annular patch type according to an embodiment of the invention, with studs distributed under the radiating element;

FIG. 6 shows an example of an antenna obtained with a first embodiment of the antenna manufacturing method according to an embodiment of the invention, based on the use of a three-dimensional (3-D) metal component and positioning supports;

FIG. 7 shows an example of an antenna obtained with a second embodiment of the antenna manufacturing method according to an embodiment of the invention, based on the use of a layer of dielectric substrate having metal-plated non-emergent holes;

FIG. 8 provides an illustration of the experimental results from a planar antenna of the half-wave patch type according to an embodiment of the invention, obtained with the second embodiment of the antenna manufacturing method according to the invention;

FIG. 9 provides an illustration of the experimental results from a planar antenna of the conventional half-wave patch type, and of dimensions identical to that of the antenna according to an embodiment of the invention, the results of which are illustrated in FIG. 8;

FIG. 10 provides an illustration of the experimental results from a planar antenna of the quarter-wave patch type according to an embodiment of the invention, obtained with the second embodiment of the antenna manufacturing method according to the invention;

FIG. 11 provides an illustration of the experimental results from a planar antenna of the conventional quarter-wave patch type, and of dimensions identical to that of the antenna according to an embodiment of the invention, the results of which are illustrated in FIG. 10;

FIG. 12 is a cross-section view of an antenna configuration with two stacked radiating elements, according to an embodiment of the invention;

FIG. 13 is a cross-section view of a variant of an antenna with one radiating element according to an embodiment of the invention, wherein the ground plane and the lower surface of the single radiating element have conductive studs;

FIG. 14 is a cross-section view of a variant of an antenna with two radiating elements according to an embodiment of the invention, wherein the ground plane and the two surfaces of the primary radiating element have conductive studs;

FIG. 15 is a cross-section view of another variant of an antenna with one radiating element according to an embodiment of the invention, wherein the ground plane is flat and the single radiating element is conformed;

FIG. 16 is a cross-section view of another variant of an antenna with two radiating elements according to an embodiment of the invention, wherein the ground plane and the two radiating elements are conformed;

FIG. 17 shows a perspective view of another variant of an antenna with one radiating element according to an embodiment of the invention, with studs made in the form of tabs distributed over the periphery of the radiating element; and FIG. 18 is a cross-section view of another variant of an antenna with three radiating elements according to an embodiment of the invention, wherein one surface of the primary radiating element and both surfaces of the intermediate radiating element have conductive studs.

DETAILED DESCRIPTION OF ILLUSTRATIVE EMBODIMENTS

In FIGS. 1 to 7, 12 and 17, one and the same element retains one and the same numerical reference from one figure to the next (in particular 1 for the radiating element, 2 for the ground plane, 3 for the dielectric between the radiating element and the ground plane, and 4 for the conductive studs).

A conventional planar antenna comprises at least one radiating element and a ground plane. At least one dielectric separates the radiating element closest to the ground plane and the ground plane itself, and the radiating elements from each other. "Dielectric" is taken to mean air or a solid material possessing characteristics closer those of air, such as for example materials of the plastic, foam type etc.

The general principle of an embodiment of the invention consists in adding to a conventional planar antenna of this type a plurality of conductive studs connected to and extending from the ground plane and/or from one or more radiating elements, so as to reduce at least one physical dimension of the radiating element or elements for a given resonant frequency.

FIG. 1 shows a perspective view of one example of a planar antenna of the half-wave patch type according to an embodiment of the invention, with conductive studs distributed solely under the radiating element. These studs 4 are connected to the radiating element 1 and extend towards the ground plane 2 without being connected to it. In this example, the antenna is modelled by two radiating slots 5, located at the two separate ends of the half-wave length (FIG. 3).

Figure 2:
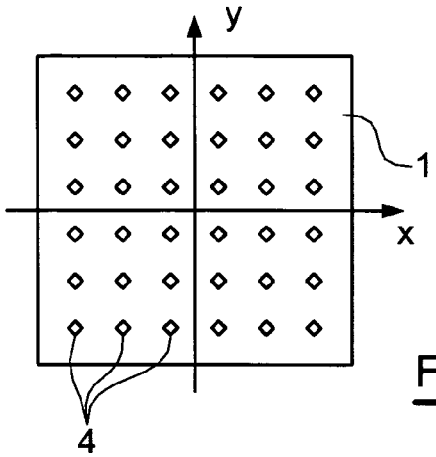
FIG. 2 is a cross-section view of the antenna in FIG. 1 along the axis B-B'.

The studs are for example distributed in accordance with a spatial distribution, known as a matrix, as shown in FIG. 2, which is a cross-section view of the antenna in FIG. 1 along the axis B-B'. This distribution may or may not be uniform. Generally speaking, any type of arrangement of the studs is conceivable, without departing from the framework of an embodiment of the present invention.

The upper part of FIG. 3 is a cross-section view of the antenna in FIG. 1 along the axis A-A', making it possible to interpret the effect of the studs positioned under the radiating element. The distribution of the electric field between the radiating element 1 and the ground plane 2 is shown in dotted arrows. The lower part of FIG. 3 is an electric modelling of the effect of the studs 4 positioned under the radiating element 1.

At the electrical level, the studs 4, positioned between the radiating pattern 1 and the ground plane 2, and solely connected to this radiating pattern 1, have the effect locally of modifying the electromagnetic field distribution, hence an increase in the equivalent capacitive effect (local capacitance C), returned to the different connection points of these studs 4 with the radiating pattern 1. Consequently, the signal phase velocity on the radiating pattern 1 diminishes, which allows at least one physical dimension (the length and/or the width) of the radiating pattern 1 to be reduced for a fixed resonant frequency (see below the reminder as to the mathematical reasoning which explains this). It should be noted that this reduction in length and/or width is directly dependent on the number of studs 4 under the radiating pattern 1, and on the positions and dimensions (length and diameter) thereof. Thus, for example, the greater the increase in the number and length of the studs, the greater the reduction in size becomes.

To clarify the above, it should be remembered that in respect of the radiating element, the phase velocity $v_\phi$ is a function of the local capacitance C and the local inductance L:

$$v_\varphi = \frac{1}{\sqrt{L \times C}}$$

Consequently, an increase in C allows $v_\phi$ to be reduced.

Furthermore, at a given resonant frequency $f_{res}$, the antenna must be equivalent to a given electrical length $\phi$. For example, for a half-wave patch type antenna: $\phi=180°$.

In fact, $\phi=\beta\times l_{physique}$, where $\beta=(2\pi f_{res}/v_\phi)$ and $l_{physique}$ is the physical length of the antenna. Therefore, $\phi=2\pi f_{res}(l_{physique}/v_\phi)$ For given $f_{res}$ and $\phi$, if $v_\phi$ diminishes, then $l_{physique}$ also diminishes, hence the miniaturisation of the antenna. Furthermore, the more C increases, the more $v_\phi$ diminishes and therefore the more $l_{physique}$ diminishes.

It is not necessary to have a uniform stud assembly. It is perfectly conceivable to design studs different in form and dimension.

To supply power to a planar antenna according to an embodiment of the invention, all conventional excitation means are conceivable, whether by a straightforward line section connected to one of the edges of the radiating element and acting as an impedance transformer to correctly adapt the antenna, by a probe connected directly to an equivalent "50Ω" point on the surface of the radiating element or by an excitation solution based on electromagnetic coupling.

In all cases, so as not to obstruct this connection with the signal processing circuits placed upstream of the antenna, it is sufficient, where necessary, not to add any studs under the area locally concerned by this interconnection between the radiating element and the power supply means.

On the other hand, in the example in FIG. 1, the symmetry along the two principal axes (X, Y in FIG. 2) of the radiating element 1 is respected. In other words, the studs are distributed according to an arrangement that respects this symmetry. It is therefore perfectly possible to use the antenna according to two crossed linear polarisations, or even in circular polarisation. The solution developed, based on studs, is not therefore per se an obstacle to the use of the antenna for any type of required polarisation.

Another fundamental point, emphasising the full extent of the advantages offered by the technique of an embodiment of the invention, lies in the ease of implementation thereof in respect of any other type of planar antenna. Indeed, the principle of conductive studs under the radiating element can be adapted without no particular difficulty to very different planar antenna configurations and geometries, whether for planar patterns with ground return, for channelled out or annular patterns, for inscribed slot patterns or in a very general way, for any other type of planar structures known to the man skilled in the art.

To illustrate this point, two other examples of planar antennas with studs according to an embodiment of the invention are given in FIGS. 4 and 5: there is a planar antenna of the quarter-wave patch type, with ground return (given the reference number 6) located on one of the support wafers 3 (FIG. 4), and a planar antenna of the annular patch type (FIG. 5).

As regards the material embodiment of planar antennas with studs according to an embodiment of the invention, several straightforward manufacturing methods are conceivable, this simplicity being a fundamental criterion for the reduction in particular of the cost of these components.

A first embodiment of the antenna manufacturing method according to the invention will now be presented in relation to FIG. 6. In this first embodiment, the radiating element (patch) 1 and the studs 4 are made as a single conductive component 7 (for example a metal component), obtained by machining, beating, or any other method used for the manufacture of three-dimensional metal components. In other words, the principal body of the conductive component 7 forms the radiating element 1, and the conductive studs 4 are conductive projections formed in the conductive component and which extend from the principal body of this component.

This component is then transferred to one or more support elements 8, allowing it to be positioned relative to the lower ground plane. A preferred solution consists in using at support level 8 a dielectric material the nature of which makes it close to air, in such a way that this support or these supports are as transparent as possible, from an electromagnetic point of view. The use is recommended, for example, of a material of the foam type for which the electrical characteristics are fully compliant with the required specifications (for example: polymeth acrylate imide foam ROHACELL HF71 from ROEHM: $\in r=1.11$ and $tg\delta=7.10^{-4}$ to 5 GHz). In an embodiment variant, the dielectric material out of which the support elements or elements are made is a plastic material, easily shaped for example by one of the known techniques.

FIG. 6 shows an example of an antenna obtained with this first embodiment of the antenna manufacturing method according to an embodiment of the invention, based on the use of a three-dimensional metal component 7 (integrating the radiating element 1 and the studs 4) and of positioning supports 8. The dielectric 3 included in the space between the radiating element 1, to which the conductive studs 4 are connected, and the ground plane 2 is, for example, air.

A second embodiment of the antenna manufacturing method according to the invention will now be presented in relation to FIG. 7. This second solution complies much more with techniques for implementing standard printed circuits.

It involves boring directly into the support substrate 3 of the antenna (which may be foam, plastic material etc, in other words a layer of dielectric material other than air), non-emergent holes (via holes) and coating with a conductive material, in a selective way, the upper surface of this substrate (so as to form the radiating element 1), and the inside of the holes extending from this upper surface (so as to form the conductive studs 4). In other words the conductive studs 4 are here embodied in the form of conductive holes.

In a preferred embodiment, the conductive material coating consists of metal plating. This metal plating can be achieved in a straightforward way for example by deposition of conductive paint or by electrochemical deposition. It is a clear that any technique known to the man skilled in the art can be used to apply the conductive material coating.

At the electrical level, the conductive holes (via holes) 4 have a similar effect to that of the conductive studs in previous solutions (conductive projections), hence the reduction in the size of the radiating element 1.

This element (support substrate 3 the upper surface of which carries the radiating element 1 and has a plurality of metal-plated holes 4) is then brought into contact, via its lower surface, with a ground plane 2 to obtain the final antenna structure.

It should be noted that, for this second solution, it is also preferable to choose a substrate of the foam type, which, as specified previously, has electrical characteristics that are fully appropriate for the implementation of planar antennas and which, furthermore, lends itself very easily to a three-dimensional configuration according to the shape required. In an embodiment variant, the support substrate is a plastic material, easily shaped by one of the known moulding techniques.

FIG. 7 shows an example of an antenna obtained with this second embodiment of the antenna manufacturing method according to an embodiment of the invention, based on the use of a dielectric substrate 3 the upper surface of which carries the radiating element 1 and has a plurality of metal-plated holes forming conductive studs 4.

A third embodiment of the antenna manufacturing method according to the invention will now be presented in relation to FIG. 17. In this third embodiment, the radiating element (patch) and the studs are made in the following way:

- a conductive component 171 (for example a metal foil) is implemented comprising a central part forming the radiating element 1;
- a plurality of conductive tabs are cut out of the periphery of this conductive component (in other words in excentric parts of this component, adjacent to the central part);
- the conductive tabs are folded back, relative to the central part, so as to form conductive studs 4 connected to the radiating element 1. Once folded back (for example orthogonally to the central part forming the radiating element), the conductive tabs 4 are for example positioned on the wafers of a substrate forming a support element 170.

FIG. 17 shows an example of an antenna obtained with this third embodiment of the antenna manufacturing method according to the invention, based on making folded back conductive tabs, which form conductive studs 4.

The radiating element is positioned relative to the ground plane or vice-versa through the use of one or more supports which can be of the same style as those shown in FIG. 6. In a preferred embodiment, the support element is nothing more than a wafer of dielectric substrate 170 the height of which is slightly greater than the height of the tabs so as to avoid any contact between the tabs and the ground plane.

To validate miniature planar antennas according to an embodiment of the invention, a first antenna prototype, of the type of antenna shown in FIG. 7, was made. This is a solution of the half-wave patch type, printed on a foam material of dimensions $50\times50\times10$ mm$^3$ and transferred to a ground plane of $100\times100$ mm$^2$. In this substrate, non-emergent holes of cylindrical geometry (with diameter $\Phi=2$ mm and with height $h=7.5$ mm) were bored evenly over the whole upper surface of the foam block. In the present case, this upper surface and the inside of the holes were metal-plated by direct deposition of a silver based conductive paint (reference: Spraylat 599B3730). At polarisation level, the choice was made to integrate a straightforward linear polarisation antenna, which then requires only one excitation point. The latter is effected through the use of a coaxial probe, connected at its end to an equivalent "50Ω" point on the upper surface of the radiating element.

It is perfectly-conceivable to have a design where the holes are of variable shape and dimension.

FIG. 8 gives an illustration of the experimental results from this first planar antenna prototype according to an embodiment of the invention. The antenna has been characterised in adaptation and in transmission along the preferred axis of radiation. Transmission measuring is based on the implementation of a straightforward link budget between the developed prototype and a reference antenna (in the present case, a printed dipole). It should be noted that, since this link budget is not obtained in an echoless chamber, the result shown allows the radiation to be shown only qualitatively.

By way of comparison, the measurements of a straightforward conventional half-wave patch antenna, also printed on foam and with dimensions identical to the previous radiating element (50×50×100 $mm^3$), are shown in FIG. 9. To allow this comparison between the two antennas, the link budget was measured under conditions entirely similar to the previous one.

As can be seen in FIGS. 8 and 9, the resonant frequency of the antenna according to an embodiment of the invention (with non-emergent holes) is much smaller than that of the conventional antenna. A reduction of 25% in the value of this resonant frequency can in fact be noted (in other words Δf=665 MHz: $f_{r\ minia.}$=1.969 GHz instead of $f_{r\ classi.}$=2.634 GHz). Outside of this significant shift in frequency, the levels of adaptation, bandwidth and radiation remain basically correct, as is shown by the responses measured on both antennas. The technique of an embodiment of the invention (adding conductive studs 4) therefore leads to significant potential for miniaturising the printed pattern (radiating element).

To emphasise the general nature of the technique of an embodiment of the invention, a second miniature antenna prototype was made: this is a quarter-wave patch antenna, with ground return located on one of the support wafers. As in the previous case, it is the principle of holes (via holes) distributed in the foam material which was selected. This antenna was printed on a substrate of dimensions 25×25×10 $mm^3$ and transferred to a ground plane of 100×100 $mm^2$. The non-emergent holes still have a cylindrical geometry (Φ=2 mm and h=7.5 mm). The ground return is implemented by a 5 mm wide tab, printed on one of the wafers of the foam support substrate and connected at its end to the ground plane. Excitation is obtained by coaxial probe connected to a "50Ω" point.

FIG. 10 provides illustration of the experimental results from this second planar antenna prototype according to an embodiment of the invention. This second prototype has also been characterised in adaptation and in transmission.

These results can be compared to those from a conventional antenna of the quarter-wave patch type, completely similar in geometry to that of the second prototype, outside the presence of the non-emergent holes, and the performance of which is given in FIG. 11.

As shown in FIGS. 10 and 11, a clear shift towards the low frequencies can again be observed for the antenna according to an embodiment of the invention (with non-emergent holes), hence the possibilities for a significant reduction in the dimension of the radiating element (basic printed pattern). In this case, the resonant frequency has dropped by about 20% (Δf=265 MHz: $f_{r\ minia.}$=1.210 GHz instead of $f_{r\ classi.}$=1.475 GHz), the other performance aspects of the antenna not seeming at first sight to have been disturbed.

Furthermore, the general principle of an embodiment of the invention (adding studs under the surface of a radiating element in order to reduce at least one physical dimension thereof (length and/or width) for a fixed resonant frequency) can also be applied to planar antennas with a number of stacked elements.

It will be remembered that multi-element antennas of this kind are used for example for broadband applications or again multi-frequency applications.

By way of example, FIG. 12 shows a cross-section view of an antenna configuration with two stacked radiating elements, according to an embodiment of the invention.

This antenna comprises a primary radiating element 1, separated from the ground plane 2 by a first dielectric 3, and an upper radiating element 10, separated from the primary radiating element 1 by a second dielectric 9.

The primary radiating element is defined as being the radiating element closest to the ground plane. The upper radiating element is defined as being the radiating element furthest away from the ground plane.

In this example, the concept of miniaturisation according to an embodiment of the invention (addition of studs 124) is only applied to the primary radiating element 1. In other words, the upper radiating element 10 is not connected to any stud.

Generally speaking, the antenna may comprise any number of stacked radiating elements and the concept of an embodiment of the invention (adding conductive studs) may be applied to all the radiating elements in the stack or only to one or more thereof.

As already mentioned above, the concept of an embodiment of the invention (adding conductive studs) may also be applied to the ground plane (adding studs to the surface thereof located facing the radiating element or elements), independently or in combination with an application to one or more radiating elements. In other words, the following different situations are conceivable in the context of one or more embodiments of the present invention:

only the ground plane has conductive studs;

only one or more radiating elements have conductive studs;

the ground plane and one or more radiating elements have conductive studs. This configuration allows the final size of the radiating element or elements to be reduced still further.

FIG. 13 is a cross-section view of a variant of an antenna with one radiating element according to an embodiment of the invention. The ground plane 132 has conductive studs 135. The lower surface of the single radiating element 131 also has conductive studs 134. There is then a matrix of first studs 134 distributed under the radiating element 131 and only connected thereto, and a matrix of second studs 135 distributed over the ground plane and only connected to this plane. These two matrices are located in the area between the upper radiating element and the lower ground plane. To avoid any contact between the studs of the two matrices, the first studs are interlaced with the second studs.

In this case, the electrical effect of the studs as described previously (in relation to FIG. 3) is accentuated, which allows the physical dimension (length and/or width) of the radiating element for a fixed resonant frequency to be reduced accordingly.

To validate this principle, a prototype of an antenna with studs connected to the radiating element and to the ground plane was made. This is a solution of the half-wave patch type, printed on a foam material of dimensions 50×50×10 mm3 and transferred to a ground plane of 100×100 mm2. Compared with a conventional half-wave patch (in other words without studs) of the same dimensions, the reduction in the resonant frequency is then very considerable: this frequency in fact drops from 2.634 GHz for the conventional antenna to 1.225 GHz for the antenna of an embodiment of the invention, giving a reduction of more than 53%. This therefore leads to possibilities for the ultra-miniaturisation of the basic printed pattern.

In the case of an antenna comprising a stack of several radiating elements, the concept of an embodiment of the invention (adding conductive studs) may also be applied simultaneously to both surfaces of one and the same radiating element (except for the last one in the stack, in other words the one that is furthest away from the ground plane). In other words, one and the same radiating element may comprise first studs which extend from its lower surface and second studs which extend from its upper surface.

FIG. 14 is a cross-section view of a variant of the antenna according to an embodiment of the invention, comprising a ground plane 142 and two radiating elements 141, 147. The ground plane 142 has conductive studs 144. The upper radiating element 147 has no studs. The primary radiating element 141 has first conductive studs 146 on its lower surface and second conductive studs 145 on its upper surface.

FIG. 18 is a cross-section view of another variant of the antenna according to an embodiment of the invention, including a ground plane 180 and three radiating elements: a primary radiating element 181 (see definition above), an upper radiating element 183 (see definition above) and an intermediate radiating element 182. An intermediate radiating element is defined as a radiating element placed between the primary radiating element and the upper radiating element. The ground plane 180 and the upper radiating element 183 have no studs. The primary radiating element 181 has conductive studs 184 on its lower surface. The intermediate radiating element 182 has first conductive studs 185 on its lower surface and second conductive studs 186 on the upper surface. Generally speaking, the fact that one and the same radiating element has conductive studs on both its surfaces allows the antenna to be miniaturised even more. In one and the same antenna, there may of course be a number of radiating elements having conductive studs on their two surfaces.

An embodiment of the present invention applies to any type of planar antenna (in the general sense already discussed above), in other words just as well to planar antennas that are actually plane as to planar antennas that are not actually plane (on account of the fact that the ground plane and/or a least one radiating element is not plane but conformed according to a given three-dimensional shape).

The FIG. 15 is a cross-section view of another variant of the antenna according to an embodiment of the invention, comprising a flat ground plane 152 and a radiating element 151 which has conductive studs 154 and is conformed (in other words has a non-plane three-dimensional shape).

FIG. 16 is a cross-section view of another variant of the antenna according to an embodiment of the invention, comprising: a ground plane 162 which has conductive studs 164 and is conformed; and two radiating elements 161, 167, which each have conductive studs 165, 166 and which are conformed. The radiating element with the reference number 161, included between the upper radiating element 167 and the ground plane 162, is called the primary radiating element.

Three examples of manufacturing techniques applied to the manufacture of a radiating element with conductive studs have been presented above in relation to FIGS. 6, 7 and 17. In the first technique, the conductive studs are conductive projections (FIG. 6). In the second technique, the conductive studs are conductive holes (FIG. 7). In the third technique, the conductive studs are conductive tabs (FIG. 17). L the first and second techniques can be used to manufacture a ground plane comprising studs. On the other hand, given that the ground plane has a dimension that is always larger than that of the radiating element, the third technique (tabs) cannot be applied to the manufacture of a ground plane comprising conductive studs.

It should be noted that in the event of the studs being made in the form of conductive holes, one and the same layer of dielectric substrate may carry the ground plane (or a first radiating element) on its lower surface and a radiating element (or a second radiating element) on its upper surface. The studs connected to the ground plane (or to the first radiating element) are made in the form of first conductive holes which extend from the lower surface of the substrate layer and do not emerge on the upper surface of the substrate layer. The studs connected to the radiating element (or to the second radiating element) are made in the form of the second conductive holes which extend from the upper surface of the substrate layer and do not emerge on the lower surface of the substrate layer.

It should also be noted that the aforementioned manufacturing techniques can be combined. For example, for the ground plane or a radiating element, a conductive component can be implemented which comprises on the one hand conductive projections, forming first conductive studs and on the other hand folded back conductive tabs, forming second conductive studs.

Of course, the invention is not limited to the embodiment examples mentioned above. Other variants may be anticipated which allow the size of the antenna to be minimised still further by playing on the number, size, shape and arrangement of the studs.

The general principle of an embodiment of the present invention may be implemented in any field of application able to use a planar antenna (mobile applications, satellite communication applications, wireless RF applications etc) in very different frequency ranges (from a few hundred MHz to a few tens of GHz).

An embodiment of the invention provides a technique, which is quite different from those used hitherto to increase the equivalent electrical length of the printed pattern (radiating element or patch) of the antenna, so as to obtain a very compact planar antenna.

An embodiment of the invention provides such a technique, which is straightforward to implement and inexpensive.

An embodiment of the invention provides such a technique that can be applied to any kind of planar radiating structures, such as basic "half-wave patch" or "quarter-wave patch" antennas, "annular patch" antennas, "inscribed slot patch" antennas, PIFA (Planar Inverted-F Antenna) antennas etc.

An embodiment of the invention provides such a technique that can be applied just as well to a planar antenna with a single radiating element as to a planar antenna that comprises a stack of several radiating elements.

An embodiment of the invention provides a corresponding method for the manufacture of planar antennas, based on very straightforward integration technologies, which allows very low-cost solutions to be found, fully adapted to the expansion in consumer markets.

Although the present disclosure has been described with reference to various embodiments, workers skilled in the art will recognize that changes may be made in form and detail without departing from the spirit and scope of the invention.

The invention claimed is:

1. A planar antenna comprising:

at least one radiating element separated from a ground plane by at least a dielectric and wherein the at least one radiating element is not in direct electrical contact with the ground plane; and a plurality of conductive studs, wherein the plurality of conductive studs i) are electrically connected to only the at least one radiating element and extend toward the ground plane without contacting the ground plane and without extending beyond a planar surface of the ground plane nearest the at least one radiating element, or ii) are electrically connected to only the ground plane and extend toward the at least one radiating element without contacting the at least one radiating element.

2. The planar antenna of claim 1, wherein the plurality of conductive studs are interlaced with a second plurality of conductive studs, wherein the second plurality of conductive studs extend from the ground plane if the plurality of conductive studs are connected to the at least one radiating element, or from the at least one radiating element if the plurality of conductive studs are connected to the ground plane.

3. The planar antenna of claim 1, wherein at least one conductive stud of the plurality of conductive studs is a conductive tab, wherein the conductive tab is formed from an outer portion of a conductive sheet, wherein the conductive tab is folded relative to a central portion of the conductive sheet, and wherein the central portion of the conductive sheet forms the at least one radiating element.

4. The planar antenna of claim 1, further comprising a support element comprising a dielectric material, wherein the support element is configured to support the ground plane or the at least one radiating element.

5. The planar antenna of claim 1, wherein at least one conductive stud of the plurality of conductive studs comprises a conductive hole extending from the at least one radiating element into the dielectric, wherein a surface of the conductive hole is coated with a conductive material.

6. A planar antenna comprising:

a first radiating element separated from a ground plane by at least a dielectric; and a first plurality of conductive studs, wherein the first plurality of conductive studs are electrically connected only to the first radiating element and extend from a surface of the first radiating element toward a second radiating element without contacting the second radiating element.

7. The planar antenna of claim 6, wherein the first radiating element is separated from the second radiating element by at least a second dielectric.

8. The planar antenna of claim 7, further comprising:

a third radiating element separated from the second radiating element by at least a third dielectric; and a second plurality of conductive studs extending from one of the third radiating element or the second radiating element toward an other of the second radiating element or the third radiating element.

9. The planar antenna of claim 6, further comprising a second plurality of conducting studs connected to the second radiating element and extending toward the first radiating element without contacting the first radiating element, wherein the second plurality of conductive studs are interlaced with the first plurality of conductive studs.

10. The planar antenna of claim 6, further comprising a second plurality of conductive studs connected to the first radiating element and extending toward the ground plane without contacting the ground plane.

11. The planar antenna of claim 6, further comprising a second plurality of conductive studs connected to the ground plane and extending toward the first radiating element without contacting the first radiating element.

12. The planar antenna of claim 6, wherein at least one of the ground plane, the first radiating element, or the second radiating element is concave.

13. The planar antenna of claim 6, wherein no conductive studs of the first plurality of conductive studs are connected to the first radiating element in an area where the first radiating element is connected to a power supply.

14. The planar antenna of claim 6, wherein the conductive studs of the first plurality of conductive studs are distributed in a matrix.

15. The planar antenna of claim 6, wherein the first plurality of conductive studs are distributed symmetrically about at least one principal axis.

16. The planar antenna of claim 6, wherein the planar antenna is one of a half-wave radiating element antenna, a quarter-wave radiating element antenna, an annular radiating element antenna, an inscribed slot radiating element antenna, or an inverted-F radiating element antenna.

17. The planar antenna of claim 6, wherein at least one conductive stud of the first plurality of conductive studs is a conductive tab, wherein the conductive tab is formed from an outer portion of a conductive sheet, wherein the conductive tab is folded relative to a central portion of the conductive sheet, and wherein the central portion of the conductive sheet forms the first radiating element.

18. The planar antenna of claim 6, further comprising a support element comprising a dielectric material, wherein the support element is configured to support the ground plane, the first radiating element, or the second radiating element.

19. The planar antenna of claim 6, wherein at least one conductive stud of the first plurality of conductive studs comprises a conductive hole extending from the first radiating element into the dielectric, wherein a surface of the conductive hole is coated with a conductive material.

20. The planar antenna of claim 6, wherein the first radiating element is a planar radiating element that lies substantially in a first plane, and wherein the plurality of conductive studs extend substantially perpendicularly from the first plane.

21. A method for manufacturing a planar antenna, the method comprising:

separating a first radiating element from a ground plane by a dielectric, wherein a first dielectric surface of the dielectric is adjacent to a first radiating surface of the first radiating element, and further wherein a second dielectric surface of the dielectric is adjacent to a first ground surface of the ground plane; and mounting a first plurality of conductive studs to the planar antenna, wherein the first plurality of conductive studs are i) mounted to the first radiating element such that the first plurality of conductive studs extend toward the ground plane without contacting the ground plane and without extending beyond a planar surface of the ground plane nearest the first radiating element, and electrically connected only to the first radiating element, ii) mounted to the ground plane such that the first plurality of conductive studs extend toward the first radiating element without contacting the first radiating element, and electrically connected only to the ground plane, or iii) mounted to the first radiating element such that the first plurality of conductive studs extend from a surface of the first radiating element toward a second radiating element without contacting the second radiating element, and electrically connected only to the first radiating element.

22. The method of claim 21, wherein the mounting the first plurality of conductive studs comprises:

forming a conductive component comprising a central portion and an outer portion;

forming conductive tabs in the outer portion of the conductive component; and folding the conductive tabs relative to the central portion to form the first plurality of conductive studs.

23. The method of claim 21, further comprising:

forming a support element including a dielectric material; and positioning the first radiating element relative to the ground plane via the support element.

24. The method of claim 21, wherein the mounting the first plurality of conductive studs comprises:

forming at least one hole in a layer of dielectric material, wherein the at least one hole is adjacent to the first radiating element; and applying a first conductive coating to the at least one hole to form a conductive hole.

25. The method of claim 21, further comprising mounting a second plurality of conductive studs to the second radiating element, wherein the second plurality of conductive studs extends toward the first radiating element without contacting the first radiating element.

26. The method of claim 25, wherein the first plurality of conductive studs are interlaced with the second plurality of conductive studs.

* * * * *

UNITED STATES PATENT AND TRADEMARK OFFICE

CERTIFICATE OF CORRECTION

PATENT NO. : 8,077,092 B2
APPLICATION NO. : 11/579078
DATED : December 13, 2011
INVENTOR(S) : Coupez et al.

It is certified that error appears in the above-identified patent and that said Letters Patent is hereby corrected as shown below:

In Fig. 10, Sheet 4 of 7, delete " 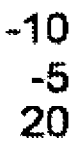 " and insert -- 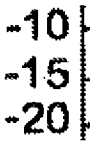 --, therefor.

In Fig. 11, Sheet 5 of 7, delete " 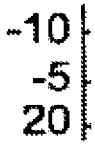 " and insert -- 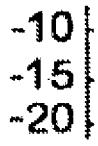 --, therefor.

In Column 2, Line 11, delete "modem" and insert -- modern --, therefor.

In Column 2, Line 56, delete "etc.," and insert -- etc. --, therefor.

In Column 11, Line 4, delete "($50\times50\times100mm^3$)," and insert -- ($50\times50\times10mm^3$), --, therefor.

Signed and Sealed this
Thirty-first Day of July, 2012

David J. Kappos

David J. Kappos
*Director of the United States Patent and Trademark Office*